United States Patent [19]

Kuus et al.

[11] 4,332,298

[45] Jun. 1, 1982

[54] VALVE ASSEMBLY FOR AN INFLATABLE PACKER SYSTEM

[75] Inventors: Felix Kuus, Huntington Beach; Gerald C. Eckmann, La Puente, both of Calif.

[73] Assignee: BJ-Hughes Inc., Long Beach, Calif.

[21] Appl. No.: 120,180

[22] Filed: Feb. 11, 1980

[51] Int. Cl.[3] ..... E21B 34/10

[52] U.S. Cl. ..... 166/319; 251/325

[58] Field of Search ..... 166/319, 187, 334, 332; 251/324, 325, 284

[56] References Cited

U.S. PATENT DOCUMENTS 3,381,756 5/1968 Reagan ..... 166/319

3,439,740 4/1969 Conover ..... 166/187

*Primary Examiner*—James A. Leppink

*Attorney, Agent, or Firm*—Robert A. Felsman

[57] ABSTRACT

A valve assembly for use in an inflatable packer system comprising an outer valve member, an inner valve member adapted to move axially relative to said outer valve member when weight is set down on and lifted from the system, and a shifting sleeve which is pumped down by inflation fluid with respect to both said inner and outer valve members to establish an inflation fluid passageway.

11 Claims, 11 Drawing Figures

458
428
452
449
442
430
454
444
450
432
436
420

486
526
484
530
532
468
490
482
488
478
494
492
464
428
480
474
458

554
552
546
524
504
550
540
508
506
526
522
520
512
528
501
502

VALVE ASSEMBLY FOR AN INFLATABLE PACKER SYSTEM

RELATED APPLICATIONS

U.S. Pat. application Ser. No. 120,418, filed Feb. 11, 1980 for an Inflatable Packer System by Felix Kuus.

U.S. Pat. application Ser. No. 124,664, filed Feb. 26, 1980 for a Valve Retrieval Mechanism For An Inflatable Packer System. .

BACKGROUND OF THE INVENTION

1. Field of The Invention

The present invention relates to a valve assembly which may be used in an inflatable packer system. Such packer systems may be employed in a drill stem or formation testing tool. The preferred embodiment of the valve assembly is intended for use, for example, in the "Inflatable Packer System" by Felix Kuus, described and claimed in U.S. Pat. application Ser. No. 120,418, filed Feb. 11, 1980. The teachings of that application are hereby specifically incorporated by reference.

The testing tool may be used to evaluate the producing potential or productivity of an oil or gas bearing zone prior to completing a well. As drilling of a bore hole proceeds, there may be indications, such as those obtained from studying the core, which suggest the desirability of testing one or more formations for producing potential.

For the test, a testing tool is attached to the drill string and lowered into the uncased well bore to isolate the zone to be tested.

It is advantageous to have a tool that can be set at any depth in the well so that several zones can be tested, if desired, on a single trip into the well. Therefore, the valving used to control inflation and deflation of the packer(s) must be designed so that the packer(s) can be inflated and deflated repeatedly.

However, all valve functions can be mechanically controlled only by rotation of the drill string and/or by weight set-down and lifting on the drill string, since those are the only actions which can be taken from the surface.

2. Description of the Prior Art

One tool for well bore testing widley used in the industry is disclosed in U.S. Pat. No. 3,439,740 granted to George E. Conover. The Conover tool is representative of that class of packer inflation systems wherein drill pipe rotatoion actuates a piston pump which displaces fluid into the packer(s).

The Conover tool has a plurality of parts which cooperate together to perform four basic operations: (1) packer inflation by drill stem rotation; (2) flow testing by applying weight set-down on the drill string; (3) shut-in pressure testing by upward pull on the drill string; and (4) packer deflation by the simultaneous application of downward and rotational forces on the drill string to actuate a clutch which allows a mandrel to move downwardly, which in turn moves a sleeve valve downwardly, thereby allowing the packer(s) to deflate. When the packers are reset, initial rotation of the pump causes hydraulic fluid to force the sleeve valve upwardly whereupon further pumping will inflate the packers again.

The Conover tool is mechanically complex due to the functional cooperation required for flow and shut-in testing as well as inflation and deflation of the packers.

For instance, the manner in which deflation of the packers is accomplished requires a complicated clutch and valving arrangement. It also requires a simultaneous application of weight and rotation to the drill string, all of which must be accomplished at the surface of the well under test.

Also in the Conover tool, there is no modularity. The pump portion and valve portion are mechanically and functionally interrelated. Therefore, in case of a pump failure or valve failure, the failure cannot be isolated to a particular module and that exchanged for a good one.

SUMMARY OF THE INVENTION

The preferred embodiment of the invention comprises a valve assembly for use in a well testing tool. The valve includes an outer valve member which may be fixed against rotation and against longitudinal movement by means of a drag spring and inflated packer(s), respectively. The outer valve member surrounds an inner valve member which may be moved down and up by means of weight set-down and lifting on the drill string after packer inflation.

The valve assembly may also incorporate a shifting sleeve which can be pumped down by initial flow of inflation fluid to establish an inflation fluid passageway through the valve.

The valve assembly is intended for use to control the flow of inflation fluid to the packer(s). It may also seal off the packer(s) upon initial weight set-down, and vent the test zone to the well annulus during weight set-down to obviate any "plunger" effect on the zone. In addition, it may be used to vent the pressurized inflation fluid to the well annulus during weight set-down. For this purpose, the term "well annulus" is intended to mean that portion of the well on either side of, and usually above, the zone of interest which is to be tested.

At the end of weight set-down, the valve assembly may seal off the test zone from the well annulus to render the zone ready for shut-in and flow testing.

On lifing, the inner valve member may retrieve the shifting sleeve, and interaction between the inner valve member and the shifting sleeve can be employed to allow the packer(s) to deflate.

The valve assembly also preferably equalizes the pressure of the test zone with that of the well annulus upon initial lifting to prevent damage to the packer(s). It may also seal off the inflation fluid vent upon lifting.

DETAILED DESCRIPTION

Valve Assembly 108

Figure 1A:
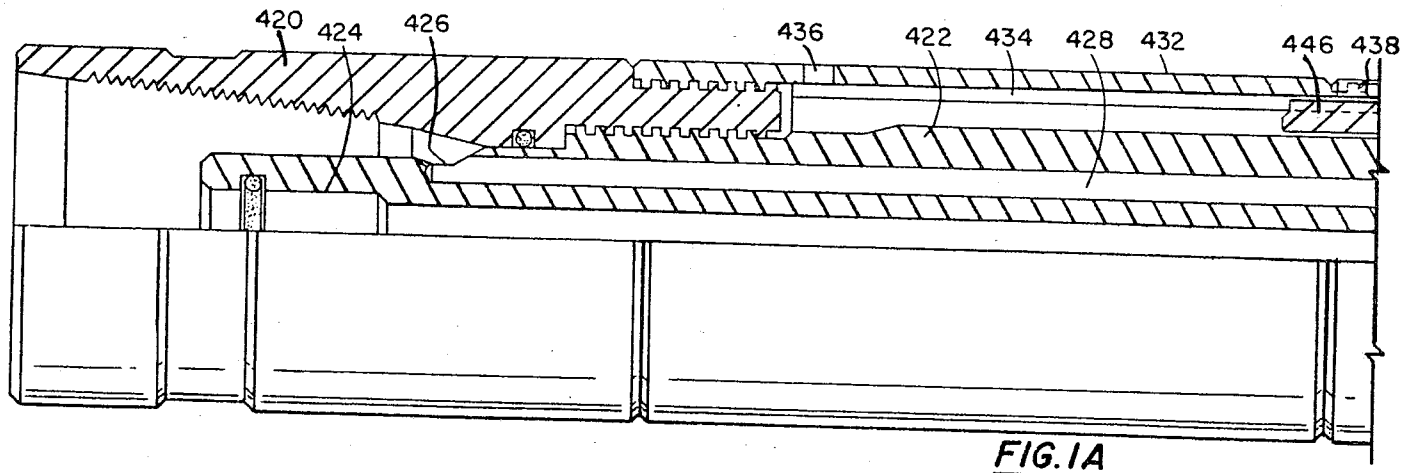
FIGS. 1A–1F show the valve assembly in the elongated or stretched positions.

A presently preferred embodiment of valve assembly 108 is shown in FIGS. 1A–1F in the elongated or stretched configuration before pump rotation is started.

In this preferred embodiment the valve assembly 108 includes a cylindrical top sub 420 which is internally threaded near the upper end and internally and externally threaded near the lower end.

The lower end of top sub 420 is threaded onto a longitudinally extending cylindrical upper connector 422 which is externally threaded near the top end thereof with an unthreaded portion extending therebeyond. A conventional O-ring carried by the top sub 420 provides a seal between the unthreaded portion of the upper connector 422 and the top sub 420. The interior diameter of the upper end of upper connector 422 is preferably enlarged as at 424 to receive the lower end of stinger from an adjacent subassembly for example. A conventional O-ring carried by the upper connector 422 may provide a seal between the upper connector 422 and the stinger 362 when the testing tool is made up.

Upper connector 422 is grooved around the exterior periphery toward the upper end as at 426. Passageways 428 running parallel to the center line in the wall of the upper connector 422 extend from the lower face thereof to the groove 426. Pressure relief vents as at 430 (FIG. 1B) extend from the outer surface of upper connector 422 to passageway 428. Upper connector 422 may also be externally threaded near its bottom end as seen in FIG. 4C.

A cylindrical spline sleeve 432, internally threaded at the upper end thereof, threadedly engages the lower end of top sub 420. Internally extending splines, as at 434, run the length of spline sleeve 432 from the threaded portion at the upper end to the lower end thereof. The spline sleeve 432 is also externally threaded at the lower end. In addition, pressure relief ports as at 436 are drilled through the wall toward the upper end thereof.

An upper ring retainer 438, internally threaded at the upper end thereof, may be threaded onto the lower end of spline sleeve 432. The lower end of upper ring retainer 438 preferably terminates in an inwardly depending collar 440. When upper ring retainer 438 is threaded onto spline sleeve 432, a release ring 442 may be clamped between the lower end of spline sleeve 432 and the upper face of collar 440.

A cylindrical torque sleeve 444 may surround a portion of the length of upper connector 422 and be internally threaded near the lower end thereof. Externally, longitudinally extending splines 446 at the upper end of torque sleeve 444 may interact with splines 434 on the interior of spline sleeve 432. Conventional O-rings carried by the torque sleeve 444 preferably provide a seal above pressure relief vent 430 between torque sleeve 444 and upper connector 422.

The internal diameter near the lower end of torque sleeve 444 may be enlarged which provides a shoulder 448 and a seat for another seal 450 between torque sleeve 444 and upper connector 422 below pressure relief vent 430. A detent or shoulder 449 may also be cut into the outer diameter of the torque sleeve 444 for seating the release ring 442. The lower, inner edge of ring 442 may be chamfered slightly to allow it to be pushed over the shoulder 449 for a purpose to be described.

A cylindrical inflation vent sleeve 452 may also surround a portion of the length of upper connector 422 and is preferably externally and internally threaded near the upper and lower ends, respectively. The upper end of inflation vent sleeve 452 bears against the lower end of seal 450 and retains the upper end of seal 450 against shoulder 448 when the upper end of inflation vent sleeve 452 is threaded into the lower end of torque sleeve 444. Pump inflation vents, as at 454, may also be drilled through the wall of inflation vent sleeve 452 toward the upper end thereof and communicate with a space 456 between the inner diameter of inflation vent sleeve 452 and the outer diameter of upper connector 422.

Figure 1B:
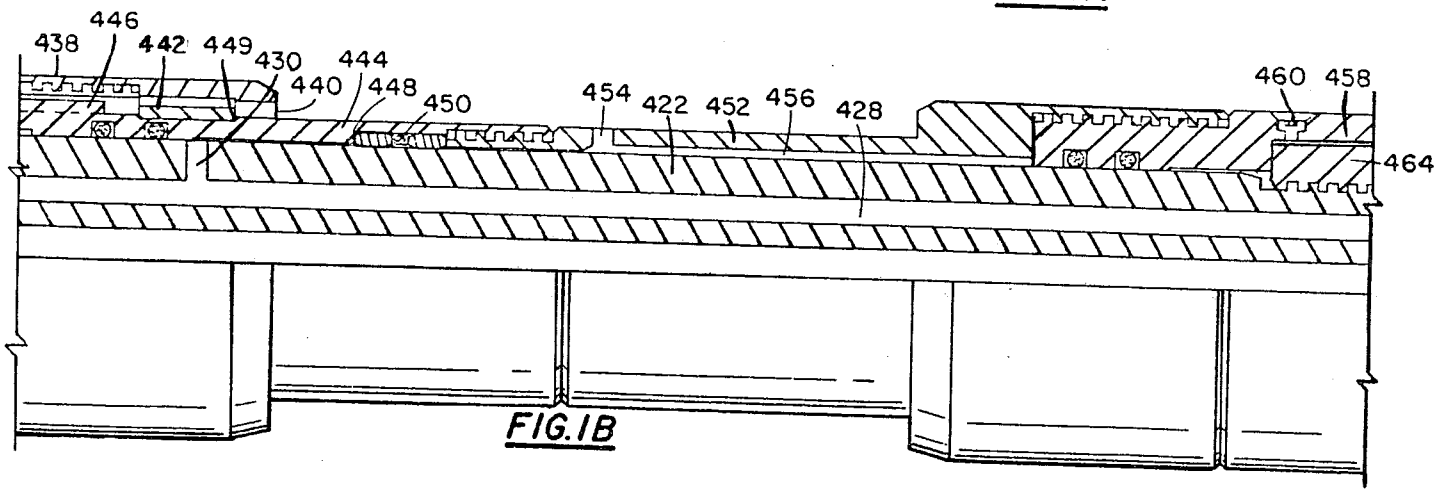
Figure 1C:
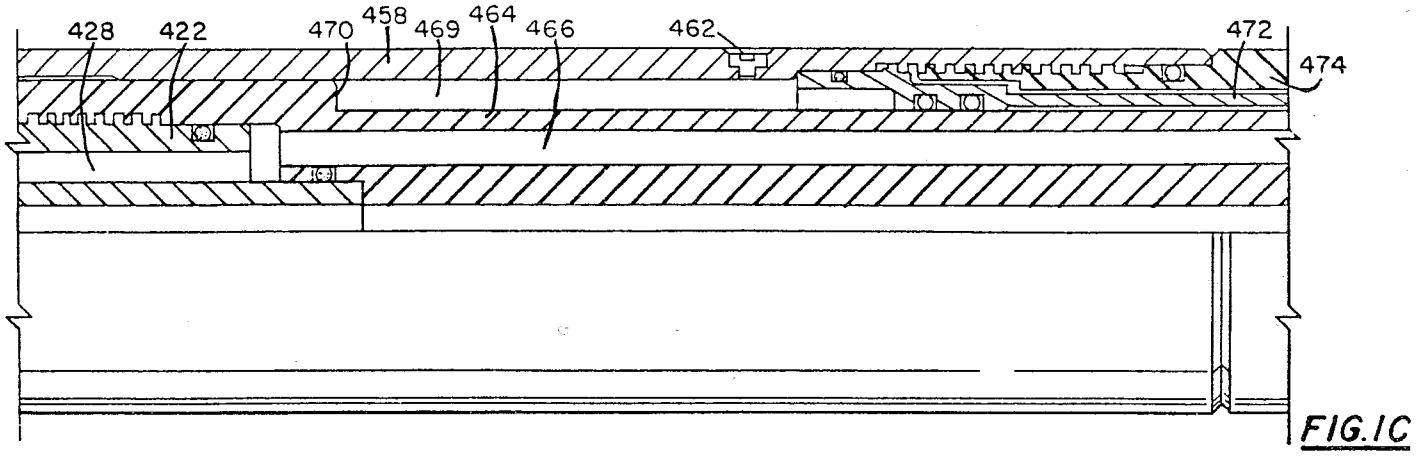

A cylindrical time-delay cylinder 458, externally threaded near its upper end and internally threaded near its lower end as shown in FIGS. 1B and 1C, may be threaded into the bottom end of inflation vent sleeve 452. The upper end of the time delay cylinder 458 may directly overlay a lower portion of upper connector 422. Holes may be drilled through the wall of the time-delay cylinder, near its top and bottom ends, and tapped to receive plugs 460 and 462, respectively. Conventional O-ring seals carried by the plugs may be used to provide for sealing between the plugs and the holes. Conventional O-rings carried by the upper end of time-delay cylinder 458 may also provide a seal between it and the upper connector 422.

Figure 1D:
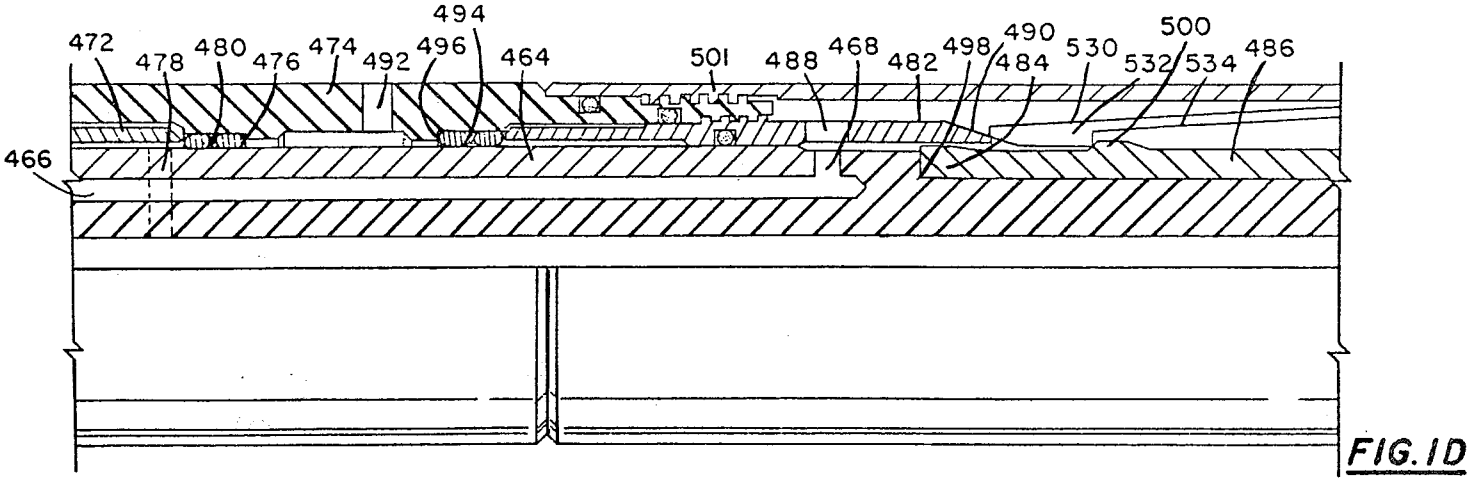

A cylindrical time-delay piston 464, internally threaded near its upper end and internally threaded near its lower end, as shown in FIGS. 1B and 1D, respectively, attaches to the bottom end of upper connector 422. A conventional O-ring carried below the threads on the lower end of upper connector 422 may be used to provide a seal between it and time-delay piston 464. Longitudinally extending coaxial passageways in the wall, as at 466, may be drilled from the top of time-delay piston 464 toward the bottom end thereof and terminate in apertures, as at 468, drilled radially through the wall of the time-delay piston in fluid communication with the external diameter thereof.

The upper ends of the passageways 466 may be in fluid communication with the lower ends of passageways 428 in the upper connector 422 (FIG. 1C). Conventional O-rings, one carried by bottom connector 422 and one carried by time-delay piston 464, preferably maintain a fluid-tight connection between the bottom end of upper connector 422 and the upper end of time-delay piston 464.

A space 469 (FIG. 1C) is provided between the inner diameter of time-delay cylinder 458 and the outer diameter of time-delay piston 464 by reducing the external diameter of the piston along a portion of its length. The reduction in the outer diameter of piston 464 also provides a downwardly facing piston face 470. In this preferred embodiment, the clearance between the time-delay cylinder 458 and time-delay piston 464, above piston face 470, is approximately three to five thousandths of an inch in diameter.

Space 469 may preferably be filled with Dow Corning fluid 200, 350 centistoke. Filling may be accomplished by removing the plugs 460 and 462 and pouring the fluid in one opening while venting air from space 469 through the other.

A cylindrical seal retainer 472 (FIGS. 1C and 1D), externally threaded near the upper end thereof and surrounding time-delay piston 464, may be threaded into the bottom end of time-delay cylinder 458. The upper end of seal retainer 472 may underlie a lower length of time-delay cylinder 458 and an O-ring carried by seal retainer 472 may provide a seal therebetween. Two conventional O-rings carried by seal retainer 472 near the upper end thereof may provide a seal between seal retainer 472 and time-delay piston 464.

An equalizing housing 474, externally threaded near the upper end and externally and internally threaded near the bottom end thereof, may be threaded into the lower end of time-delay cylinder 458. An O-ring carried by the equalizing housing 474 maintains a seal between time-delay cylinder 458 and equalizing housing 474.

An upwardly facing, inwardly depending shoulder 476 may be formed on the inner diameter of equalizing housing 474, about midway of its length and below radially extending relief vents, as at 478, drilled through the wall of time-delay piston 464.

Sealing between equalizing housing 474 and time-delay piston 464 just below relief vents 478 may be accomplished by a seal 480. Seal 480 is maintained in position longitudinally between the bottom end of seal retainer 472 and shoulder 476 on equalizing housing 474.

A cone and seal spacer 482, externally threaded approximately midway along its length, threads into the bottom end of the equalizing housing 474 and surrounds time-delay piston 464. Sealing between the cone and seal spacer 482 and the lower length of time delay piston 464 may be provided by a conventional O-ring carried by the cone and seal spacer 482. Another conventional O-ring carried by equalizing housing 474 may provide a seal against cone and seal spacer 482.

The bottom half of the cone and seal spacer 482 overlies openings 468 in time-delay piston 464 and a primary bump 484 on a retrieving sleeve 486. Ports, as at 488, may be drilled through the wall of the cone and seal spacer 482 in fluid communication with openings 468 in the lower length of time-delay piston 464. The lower end of the cone and seal spacer 482 is preferably tapered from the outer diameter to approximately the inner diameter thereof to provide a lifting ramp 490.

Equalizing ports, as at 492 (FIG. 1D), may be drilled through the wall of equalizing housing 474 near the lower end thereof. Sealing between the equalizing housing 474 and time-delay piston 464 below the holes 492 may be accomplished by means of a seal 494. Seal 494 is restrained longitudinally between the upper end of cone and seal spacer 482 and a downwardly facing shoulder 496 on the inner diameter of equalizing housing 474 below equalizing ports 492.

Retrieving sleeve 486 preferably surrounds the lower end of time-delay piston 464 and the upper end thereof bears against a downwardly facing shoulder 498 formed on the outer diameter of the time-delay piston 464. A radially extending secondary bump 500 also extends around the outer periphery of retrieving sleeve 486 below the primary bump 484 and spaced therefrom in the manner shown.

A cylindrical sleeve housing 501 (FIGS. 1D and 1E), internally threaded near both ends, threadedly engages the bottom end of equalizing housing 474. A conventional O-ring carried by equalizing housing 474 may provide a seal between the sleeve housing 501 and equalizing housing 474 above the common threaded portion. Deflate ports 502 may also be drilled through the wall of sleeve housing 501 approximately midway along the length thereof.

A cylindrical lower mandrel 504 (FIGS. 1E and 1F), externally threaded near both ends, threadedly engages the externally threaded lower end of time-delay piston 464. The lowermost unthreaded length of time-delay piston 464 preferably overlies an unthreaded length of lower mandrel 504. A conventional O-ring carried by lower mandrel 504 may provide a seal between the common lengths of time-delay piston 464 and lower mandrel 504.

A cylindrical lower connector 506, internally threaded at its lower end and surrounding lower mandrel 504, threadedly engages the lower end of lower mandrel 504. The inner diameter of the lower connector 506 bears against the outer diameter of the lower mandrel 504 at the upper and lower ends. A passageway 508 is provided between the common lengths of the inner diameter of lower connector 506 and outer diameter of lower mandrel 504, for example, by reducing the outer diameter of lower mandrel 504 between the ends thereof. Conventional O-rings carried by lower mandrel 504 provide seals between the upper and lower ends of the lower mandrel 504 and lower connector 506.

Surrounding the outer periphery of lower connector at its upper end, in descending order, are a seal 510, a seal spacer 512, a connector split ring 514, and another seal 516. The outer diameter of the lower connector 506 may be reduced along the length underlying seal 510, seal spacer 512, and seal 516 and grooved to accommodate the connector split ring 514. Connector split ring 514 may protrude above the outer diameter of lower connector 506 and fit into an internally enlarged lower end of seal spacer 512.

The reduction in the outer diameter of the upper length of lower connector 506 also provides an upwardly facing shoulder 518. Seal 516 is restrained longitudinally between the lower end of seal spacer 512 and shoulder 518. Seal 510 is restrained longitudinally between the lower end of retrieving sleeve 486 and the upper end of seal spacer 512, which in turn bears against connector split ring 514.

Concentrically aligned deflate ports as at 520 and 522 in FIG. 1E, may be drilled through the walls of lower connector 506 and seal spacer 512 respectively, above connector split ring 514 and below seal 510. In addition, inflation fluid ports, as at 524 (FIG. 1F), may be drilled through the wall of lower connector 506 near the lower end thereof in fluid communication with passageway 508.

A cylindrical shifting sleeve 526 (FIG. 1E) preferably surrounds the upper length of lower connector 506 and overlies seal 510, seal spacer 512, and seal 516. The internal diameter of the shifting sleeve 526, from seal 516 downwardly, rides on the external diameter of the lower connector 506 and is adapted to move axially with respect thereto. The internal diameter of the shifting sleeve 526 may be radiused where it overlies seals 510 and 516 as shown in more detail in FIG. 1G. Other deflate ports as at 528 may be drilled through the wall of shifting sleeve 526 in line with deflate ports 502, 522, and 520 in the walls of the sleeve housing 501, seal spacer 512, and lower connector 506, respectively.

The outer diameter of shifting sleeve 526, toward its upper end, bears against the inner diameter of sleeve housing 501 and a conventional O-ring carried by the shifting sleeve 526 may provide a seal therebetween. The uppermost portion of shifting sleeve 526 may have a reduced outer diameter and be externally threaded. Threadedly attached thereto may be the lower, internally threaded end of a collet 530.

The collet may comprise a ramp 532 (FIG. 1D) and spring 534 which may be integral. The ramp 532 tapers upwardly from the inner diameter to nearly the outer diameter thereof. The collet 530 is also split longitudinally from the top end of the ramp 532 to the juncture of the spring 534 with the threaded portion thereof as seen in FIG. 1E.

A bottom sub connector 536 (FIGS. 1E and 1F), externally threaded near the upper end and internally threaded near the bottom end, preferably threadedly engages the lower end of sleeve housing 501. The inner diameter of the upper end of the bottom sub connector 536 may bear against the outer diameter of lower connector 506 and a conventional O-ring carried by bottom sub connector 536 may provide a seal between it and the lower connector 506. Three screws spaced at 120°, one of which is shown at 538, may also be threaded into the upper face of bottom sub connector 536.

Two fluid ports 540 may be drilled through the wall of the bottom sub connector and sealed with pipe plugs 542, as shown. The internal diameter of the bottom sub connector 536, below fluid port 540, may be enlarged to provide a downwardly facing shoulder 544. Passageways, as at 545, may be drilled through the shoulder 544 for communication with fluid ports 540.

A bottom sub 546 (FIG. 1F), externally threaded near the upper end thereof, may threadedly engage the lower end of bottom connector 536. The lowermost length of bottom sub connector 536 may overlie bottom sub 546 and a conventional O-ring carried by the bottom sub 546 used to provide a seal therebetween. The uppermost length of bottom sub 546 may extend into the enlarged internal diameter of bottom sub connector 536.

The inner diameter of the upper end of the bottom sub 546 may be enlarged to generate an upwardly facing shoulder 548, against which the lower end of a seal 550, carried in the resulting enlargement, bears. The upper end of seal 550 may also abut downwardly facing shoulder 544 on bottom sub connector 536. The inner diameter of the bottom sub 546, near the upper end thereof, may bear against the outer diameter of the lower connector 506 and a conventional O-ring carried by the bottom sub 546 used to provide a seal therebetween.

Axially extending fluid passageways, as at 552, may be formed in the wall of bottom sub 546 from the top end toward the bottom end thereof. The passageways may terminate at fluid ports, as at 554, which are formed to extend radially through the wall of bottom sub 546 near the bottom end thereof. The ports 554 may be closed by pipe plugs 556.

The lower end of the bottom sub 546 may be tapered from the outer diameter toward the inner diameter and externally threaded. A conventional O-ring may be carried by the bottom sub 546 just above the threaded portion at the lower end thereof. The bottom sub 546 may also be internally threaded near the lower end thereof and enlarged in diameter to produce a downwardly facing shoulder 558.

A cylindrical adapter 560 may fit within the lower end of bottom sub 546 so that the external diameter at the upper end thereof bears against the internal diameter of bottom sub 546. A conventional O-ring carried by the adapter 560 may provide a seal between the upper, outer surface of the adapter 560 and the inner diameter of the bottom sub 546.

The outer diameter of the adapter 560 may be reduced below the O-ring seal and the reduction terminated at a radially extending collar 562 on adaptor 560. The reduction in outer diameter contributes to forming a fluid passageway 561 between the inner diameter of bottom sub 546 and the outer diameter of adapter 560. In addition, passageways, as at 563, may be axially formed through the collar 562 in fluid communication with passageway 561.

A cylindrical adapter nut 564, externally threaded near the lower end thereof, may be threaded into the lower end of adapter 560. The upper end of the adapter nut 564 thus bears against the lower face of collar 562 and holds the upper face thereof against shoulder 558.

The lowermost end portion of adapter 560 below collar 562 may be reduced in diameter and adapted to fit within the next lower module in the test string.

Operation of Valve 108

When a testing tool is made up, the upper end of top sub 420 may be threaded onto the lower end of an adjacent subassembly, e.g., a check/relief valve (not shown). The lower end of a stinger in such a check/relief valve then fits into enlarged diameter 424 of upper connector 422 in the valve 108. Passageway 372 in check/relief valve 106 is then in fluid communication with passageway 428 in upper connector 422 of valve 108.

Basically, the valve 108 can be considered a telescoping unit. The outer portions of the valve 108, i.e., torque sleeve 444 (FIG. 1B), inflation vent sleeve 452 (FIG. 1B), time-delay cylinder 458 (FIGS. 1B and 1C), equalizing housing 474 (FIGS. 1C and 1D), sleeve housing 501 (FIGS. 1D and 1E), bottom sub connector 536 (FIGS. 1E and 1F), and bottom sub 546 (FIG. 113) are connected to the testing tool below the valve 108 and are held stationary during a test cycle by the inflation of packer 112 singly or packers 112 and 122, in the case of straddle packer test.

The inner portions of the valve 108, i.e., top sub 420 (FIG. 1A), spline sleeve 432 (FIG. 1A), upper connector 422 (FIGS. 1A–1C), time delay piston 464 (FIGS. 1B–1E), lower mandrel 504 (FIGS. 1E and 1F), lower connector 506 (FIGS. 1E and 1F), and any components carried thereby, are connected to the testing tool above the valve 108 and move up and down with the drill string during a test cycle.

As the testing tool is run into the well, valve 108 is in the elongated or stretched position shown in FIGS. 1A–1F. It is held in the elongated or stretched positions by release ring 442 (FIG. 1B) which requires sufficient weight set-down on the drill string to push it over the shoulder 449 and downwardly along the outer circumference of sleeve 444 as will be described presently.

In the stretched configuration and before pump rotation is started, the various ports and vents are positioned as follows:

1. Pump pressure relief vents 430 in upper connector 422 (FIG. 1B) are closed between seal 540 and conventional O-rings, all carried by torque sleeve 444, below and above the pump pressure relief vents 430, respectively.
2. Relief vents 478 in time-delay piston 464 (FIG. 1D) are closed off by seal 480 and the O-rings at the upper end of retainer 472, thereby isolating the inside of the tool below valve 108 from the well annulus.
3. Ports 488 in the cone and seal spacer 482 (FIG. 1D) are always open.
4. Deflate ports 520, 522, and 528 (FIG. 1E) in the lower connector 506, seal spacer 512, and shifting sleeve 526, respectively, are open to the well annulus through deflate ports 502 in sleeve housing 501.
5. Inflation port 524 in the lower end of lower connector 506 (FIG. 1F) is open.
6. Pressure relief ports 436 in the spline sleeve 432 (FIG. 1A) are always open.

When the testing tool has been run into the proper depth, a pump is activated. Inflation fluid flows down passageway 428 in upper connector 422, passageway 466 and holes 468 in time delay piston 464, and ports 488 in cone and seal spacer 482 to enter the space above shifting sleeve 526.

At this point, shifting sleeve 526 is held against downward movement by virtue of ramp 532 engaging secondary bump 500 (FIG. 1D) and seals 510 and 516 (FIGS. 1E and 1G) having snapped into position into the matching radii cut into the inner 26 diameter of shifting sleeve 526.

Pressure buildup above the shifting sleeve 526 moves it downwardly, causing ramp 532 to ride over secondary bump 500 and seals 510 and 516 to disengage from their respective radii. Sleeve 526 moves downwardly until the lower face thereof abuts the heads of screws 538 in the upper face of bottom sub connector 536.

Figure 1E:
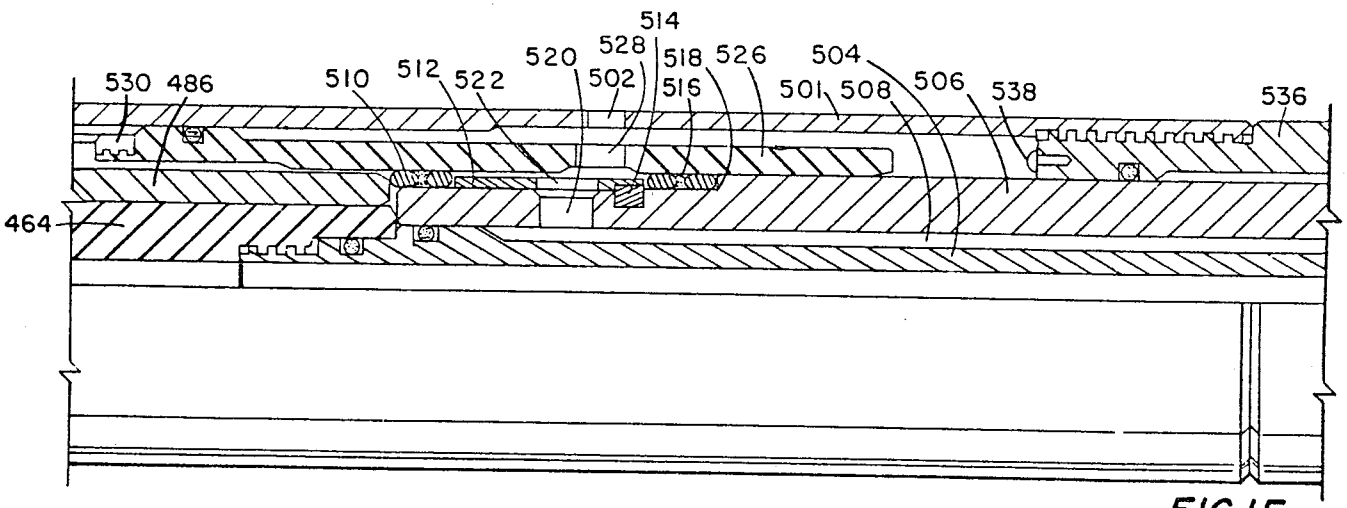
Figure 1F:
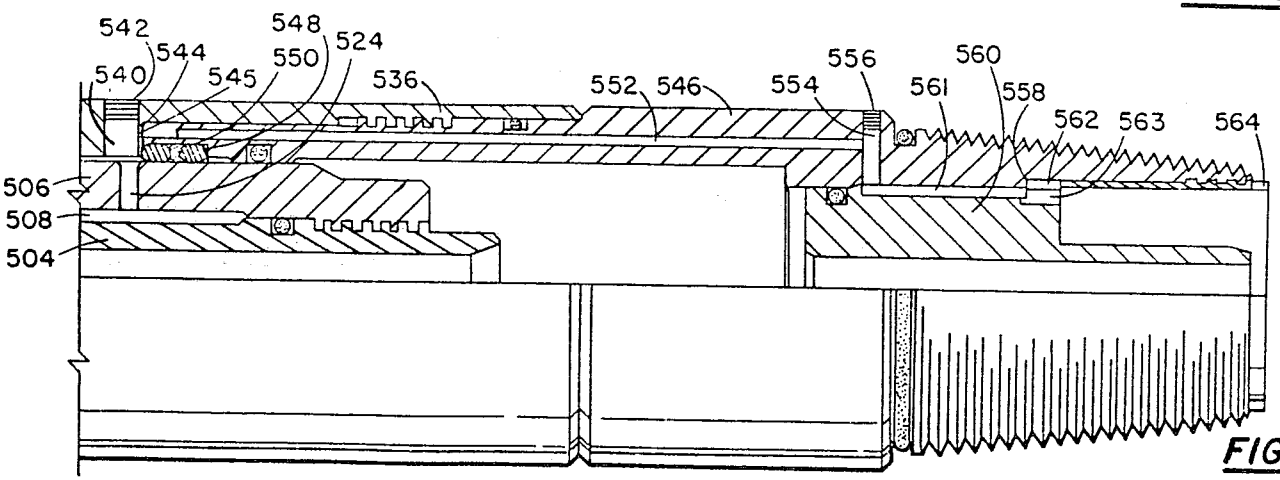

During downward movement of shifting sleeve 526, pressure balance to prevent hydraulic load on shifting sleeve 526 is accomplished through deflate port 502 in sleeve housing 501 (FIG. 1E). As shifting sleeve 526 moves downwardly, well fluid in the space below the shifting sleeve 526 is vented to the well annulus through deflate ports 502.

Figure 1H:
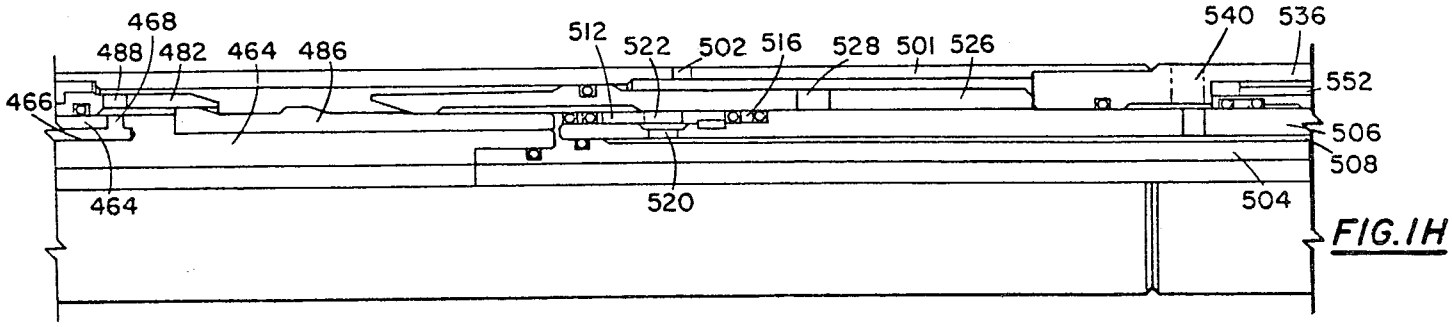
FIG. 1H shows the shifting sleeve in the pumped-down position.
Figure 1G:
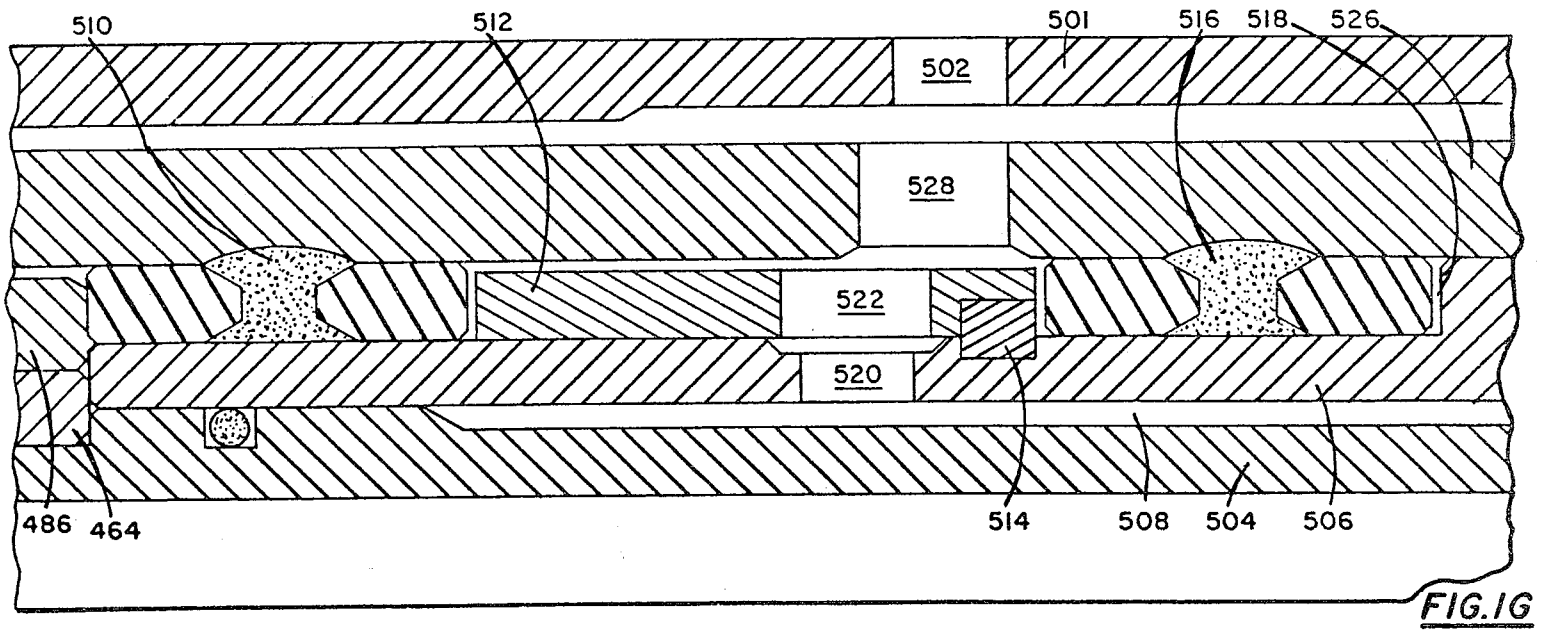
FIG. 1G illustrates a detail of the shifting sleeve and seal interrelationship.

At this point, the shifting sleeve 526 is in the position shown in FIG. 1H and the ports associated therewith are positioned as follows:

1. Deflate port 528 in shifting sleeve 526 has been sealed off due to having moved below seal 516 carried by lower connector 506.
2. Ports 520 and 522 in the lower connector 506 and seal spacer 512, respectively, are in fluid communication with ports 488 in cone and seal spacer 482 and passageway 508 between lower mandrel 504 and lower connector 506.

Inflation fluid is then free to fow from ports 488 in cone and seal space 482 into the space between the outer diameter of seal spacer 512 and inner diameter of shifting sleeve 526. Ports 522 and 520 in the seal spacer 512 and lower connector 506, respectively, are open and inflation fluid continues flowing into passageway 508 to ports 524 in the wall of the lower length of lower connector 506. Fluid flow continues through ports 540 and passageway 545 in the bottom sub connector 536 to passageway 552 and ports 554 in bottom sub 546. Finally, fluid exits valve 108 through passageway 561 between the inner diameter of bottom sub 546 and the outer diameter of adapter 560 and then through bores 563 formed in collar 562 on adapter 560.

Continued pump rotation maintains the flow of inflation fluid to the packers until they are fully inflated.

After inflation pressure has been reached, packer setting is verified by lifting on the string and observing a weight indicator. Weight is then applied to the drill string against the counterforce supplied by the set packers.

Release ring 442 pushes over shoulder 449 on inflation vent sleeve 452 and the applied weight starts closing the stretched or elongated valve 108. The interaction between release ring 442 and shoulder 449 prevents valve 108 from telescoping during running in when high friction could be present, as in directional drilling, undersize holes, etc.

As seen in FIG. 1A, pressure buildup between the top sub 420 and torque sleeve 444 is prevented during telescoping of the valve 108 by pressure relief ports 436 in the wall of spline sleeve 432. Drilling mud escapes through ports 436 as top sub 420 moves downwardly relative to torque sleeve 444.

First, as the valve telescopes, ports 524 in lower connector 506 (FIG. 1F) pass under seal 550 carried by bottom sub 546. The inflation passage to the packers is thus sealed off to prevent packer deflation. Simultaneously therewith, the relief vents 478 in the time-delay piston 464 (FIG. 1D) pass under seal 480 carried by equalizing housing 474. The interior of the tool and, therefore, the space between the packers, i.e., the test zone, is then in fluid communication with the well annulus through relief vents 478 in the time-delay piston 464 and equalizing ports 492 in the wall of equalizing housing 474. This compensates for the "plunger" effect on the test zone as weight is set down on the drill string.

Valve 108 continues telescoping at a rate governed by the interaction between time-delay piston 464 and time-delay cylinder 458 as determined by the clearance between them, which is preferably between three and five thousandths inch on the diameter. This allows the viscous fluid in space 469, such as Dow Corning 200, 350 centistoke, for example, to slowly be displaced through the clearance. Conventional O-rings above and below volume 469 prevent contamination of the fluid with drilling mud.

Next, pump pressure relief vents 430 in upper connector 422 (FIG. 1B) pass under seal 450 carried by torque sleeve 444. This puts inflation passageway 428 in upper connector 422 in fluid communication with the well annulus through pump inflation vents 454 in the inflation vent sleeve 452. Thus, pressurized inflation fluid above the sealed off packers is vented to the well annulus.

Valve 108 continues telescoping and relief vent 478 in time-delay piston 464 (FIG. 1D) passes under seal 494 carried by equalizing housing 474 and sleeve retrieval bump 484 on retrieving sleeve 486 passes under ramp 532 on collet 530. Relief vent 478 passing under seal 494 seals off and prevents fluid communication between the test zone and the well annulus through equalizing ports 492 in equalizing housing 474. Sleeve retrieval bump 484 passing under 4 ramp 532 prepares the shifting sleeve 526 for retrieval.

Figures 1I, 1J, 1K:
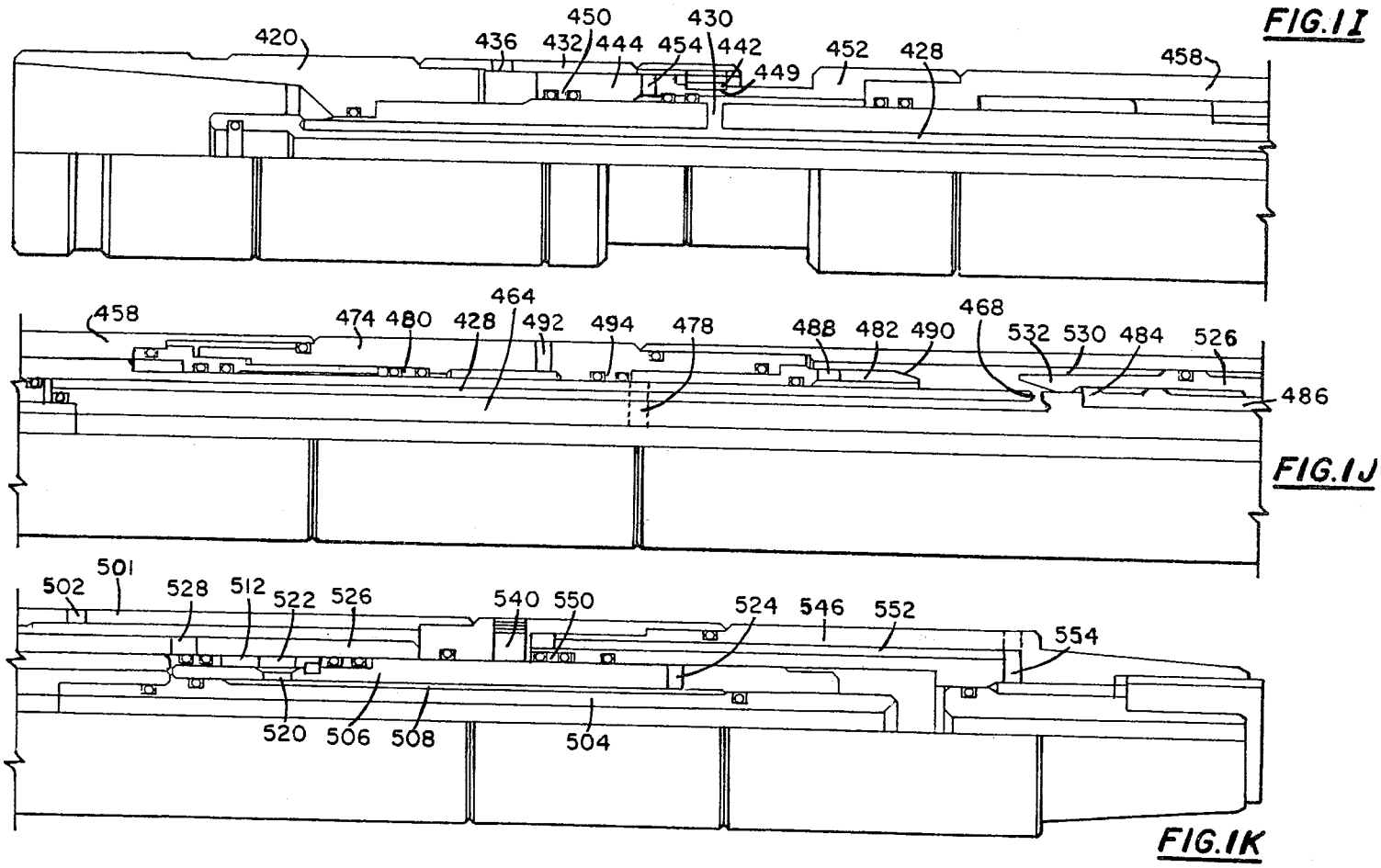
FIGS. 1I–1K illustrate the valve in the closed position after weight set-down.

Valve 108 continues closing until it is completely collapsed and piston face 470 on time-delay piston 464 (FIG. 1G) has completely traversed space 469. Valve 108 is then 8 in the position shown in FIGS. 1I–1K, ready for drill stem testing, such as, for example, flow and shut-in testing.

Upon completion of the testing, a steady pull is applied to the drill string to slowly elongate valve 108. The rate of elongation is again controlled by the clearance between the time delay piston 464 and time delay cylinder 458. As before, the outside of the valve 108 and the lower portion of the testing tool is held from coming up due to the packers yet being inflated.

During the picking up stroke, relief vents 478 in the time-delay piston 464 (FIG. 1D) cross back under seal 494 carried by equalizing housing 474. This allows fluid communication and thus equalization between the test zone and the well bore through equalizing ports 492 in equalizing housing 474. Therefore, the annulus above the packer(s) will equalize with the tested formation zone and prevent packer damage during deflation.

Second, sleeve retrieval bump 484 on retrieving sleeve 486 moves up and catches ramp 532, part of collet 27 530, on shifting sleeve 526 (FIG. 1D). Shifting sleeve 526 continues moving up with retrieving sleeve 486 until ramp 532 on collet 530 is cammed outwardly by engagement with lifting ramp 490 on cone and seal spacer 482. At this point, sleeve retrieval bump 484 rides under ramp 532 and upward movement of shifting sleeve 526 stops.

Next, the pressure relief vents 430 in the wall of upper connector 422 (FIG. 1B) cross back under seal 450 carried by torque sleeve 444. This seals off inflation passage 428 in upper connector 422 to prevent communication thereof with the well annulus through pump inflation vents 454 in the wall of inflation vent sleeve 452.

As valve 108 continues elongating, fluid ports 524 in the wall of lower connector 506 (FIG. 1F) cross back under seal 550. This allows packer deflation through passageway 508 between the inner diameter of lower connector 506 and outer diameter of lower mandrel 504 and deflate ports 520, 522, 528, and 502 in lower connector 506 (FIG. 1E), seal spacer 512, shifting sleeve 526, and sleeve housing 501, respectively.

Next, relief vents 478 in the wall of time delay piston 464 (FIG. 1D) cross back under seal 480 carried by equalizing housing 474. The bore is thus again sealed off from the well annulus through equalizing ports 492 in the wall of equalizing housing 474.

Finally, release ring 442 carried by upper ring retainer 438 snaps back below shoulder 449 on torque sleeve 444. Now valve 108 is back in its original stretched or elongated position, ready to be either relocated in the well for more testing or retrieved from the well.

In addition to the preceding normal operation of valve 108, torque may be transmitted through the valve. This may be accomplished through the interaction of splines 434 on spline sleeve 432 with splines 446 on torque sleeve 444 (FIG. 1A).

Having now reviewed this Detailed Description and the illustrations of the presently preferred embodiment of this invention, those skilled in the art will realize that the invention may be employed in a substantial number of alternate embodiments. Even though such embodiments may not even appear to resemble the preferred embodiment, they shall nevertheless employ the invention as set forth in the following claims.

We claim:

1. A valve assembly, intended for use in a well testing tool to be used in testing a zone of interest in a well having an annulus, for controlling the flow of inflation fluid to inflatable elements and the deflation thereof and adapted to be responsive to flow of inflation fluid and weight set-down and lifting on the testing tool comprising:

an outer valve member adapted to be fixed against rotation and up-down movement;

an inner valve member adapted for up-down movement with respect to said outer valve member; and shifting sleeve means in said valve assembly between said inner and outer valve members adapted to be shifted longitudinally downwardly with respect to said outer valve member upon initial flow of inflation fluid in said valve assembly to establish an inflation fluid passageway through said valve assembly.

2. A valve assembly intended for use in a well testing tool to be used in testing a zone of interest in a well having an annulus, for controlling the flow of inflation fluid to inflatable elements and the deflation thereof and adapted to be responsive to flow of inflation fluid and weight set-down and lifting on the testing tool comprising:

an outer valve member adapted to be fixed against rotation and up-down movement;

an inner valve member adapted for up-down movement with respect to said outer valve member;

shifting sleeve means in said valve assembly adapted to be shifted longitudinally downwardly with respect to said outer valve member upon initial flow of inflation fluid into said valve assembly to establish an inflation fluid passageway through said valve assembly;

port means in said inner valve member comprising part of said inflation fluid passageway;

sealing means between said inner valve member and said outer valve member;

said inner valve member being movable between an upward port-open position and a downward position when weight is set down on the testing tool whereby said port means in said inner valve member pass under said sealing means to prevent element deflation via said inflation fluid passageway.

3. A valve assembly intended for use in a well testing tool to be used in testing a zone of interest in a well having an annulus, for controlling the flow of inflation fluid to inflatable elements and the deflation thereof and adapted to be responsive to flow of inflation fluid and weight set-down and lifting on the testing tool comprising:

an outer valve member adapted to be fixed against rotation and up-down movement;

an inner valve member adapted for up-down movement with respect to said outer valve member;

shifting sleeve means in said valve assembly adapted to be shifted longitudinally downwardly with respect to said outer valve member upon initial flow of inflation fluid into said valve assembly to establish an inflation fluid passageway through said valve assembly;

port means in said inner valve member comprising part of said inflation fluid passageway;

sealing means between said inner valve member and said outer valve member;

said inner valve member being movable between an upward port-open position and a downward position when weight is set down on the testing tool whereby said port means in said inner valve member pass under said sealing means to prevent element deflation via said inflation fluid passageway; and zone venting means, in said inner valve member and said outer valve member, in fluid communication with the zone and the well annulus outside said valve assembly for venting the zone to the well annulus during weight set-down.

4. A valve assembly intended for use in a well testing tool to be used in testing a zone of interest in a well having an annulus, for controlling the flow of inflation fluid to inflatable elements and the deflation thereof and adapted to be responsive to flow of inflation fluid and weight set-down and lifting on the testing tool comprising:

an outer valve member adapted to be fixed against rotation and up-down movement;

an inner valve member adapted for up-down movement with respect to said outer valve member;

shifting sleeve means in said valve assembly adapted to be shifted longitudinally downwardly with respect to said outer valve member upon initial flow of inflation fluid into said valve assembly to establish an inflation fluid passageway through said valve assembly;

port means in said inner valve member comprising part of said inflation fluid passageway;

sealing means between said inner valve member and said outer valve member;

said inner valve member being movable between an upward port-open position and a downward position when weight is set down on the testing tool whereby said port means in said inner valve member pass under said sealing means to prevent element deflation via said inflation fluid passageway; and zone venting means, in said inner valve member and outer valve member, in fluid communication with the zone and the well annulus outside said valve assembly for venting the zone to the well annulus during weight set-down and, after testing the zone, upon initial lifting on said valve assembly.

5. A valve assembly as set forth in claim 3 and further including;

inflation vent means, in said inner valve member and outer valve member, for venting pressurized inflation fluid to the well annulus after said port means in said inner valve portion has been closed by said sealing means.

6. A valve assembly as set forth in claim 4 and further including;

inflation vent means, in said inner valve member and outer valve member, for venting pressurized inflation fluid to the well annulus after said port means in said inner valve portion has been closed by said sealing means.

7. A valve assembly as set forth in claim 3, 4, 5, or 6 and further including;

other sealing means between said inner valve member and outer valve member;

said zone venting means in said inner valve member being movable so as to be closed by said other sealing means near the end of the travel of the inner valve member upon weight set-down to prevent fluid communication between the zone and the well annulus during testing.

8. A valve assembly as set forth in claim 7 wherein;

upon completion of testing and initial lifting on said valve assembly, said zone venting means in said inner valve member is moved relative to said other sealing means to restore fluid communication between the zone and the well annulus to equalize the pressure within the zone and the well annulus pressure outside the valve.

9. A valve assembly as set forth in claim 8 and further including;

time delay cylinder means comprising part of said outer valve member; and time delay piston means, comprising part of said inner valve member, positioned within said time delay cylinder means and cooperating therewith to provide a time delay when weight is set down on the valve assembly.

10. A valve assembly as set forth in claim 9 and further including;

shifting sleeve pickup means adapted to move with said inner valve portion so that upon lifting on said valve assembly, said shifting sleeve means is moved upwardly toward its original starting position.

11. A valve assembly as set forth in claim 10 and further including;

deflation vent means in said shifting sleeve means in fluid communication with said inflation fluid passageway;

additional deflation vent means in said outer valve member in fluid communication with the well annulus and the deflation vent means in said shifting sleeve means;

so that element inflation fluid is vented to the well annulus when lifting is applied to said valve assembly and said port means in said inner valve member moves relative to said sealing means to a position providing for deflation of an inflated element.

* * * * *